US006006902A

United States Patent [19]

Weaver

[11] Patent Number: 6,006,902

[45] Date of Patent: Dec. 28, 1999

[54] MULTIPLE MODULES CONTAINER CARRIER

[75] Inventor: William N. Weaver, Northbrook, Ill.

[73] Assignee: Illinois Tool Works Inc., Glenview, Ill.

[21] Appl. No.: 09/161,131

[22] Filed: Sep. 25, 1998

[51] Int. Cl.[6] ..... B65D 75/00

[52] U.S. Cl. ..... 206/150; 53/398

[58] Field of Search ..... 493/363, 330, 493/328; 53/398, 48.1, 48.3, 48.4; 206/150, 151, 158, 147, 153; 294/87.2

[56] References Cited

U.S. PATENT DOCUMENTS

| | | | |
|---|---|---|---|
| 3,200,944 | 8/1965 | Rapata . | |
| 3,341,005 | 9/1967 | Poupitch . | |
| 4,617,223 | 10/1986 | Hiscock et al. . | |
| 4,846,585 | 7/1989 | Boeckmann et al. . | |
| 5,098,144 | 3/1992 | Marvin . | |
| 5,305,877 | 4/1994 | Olsen | 206/150 |
| 5,441,147 | 8/1995 | Tanner . | |
| 5,441,320 | 8/1995 | Strong . | |
| 5,695,050 | 12/1997 | Weaver | 206/151 |
| 5,868,659 | 2/1999 | Slomski | 206/150 |

OTHER PUBLICATIONS

Thomas Bezigian: Designer resins offer unique combination of properties, *Converting Magazine*, Dec. 1997, pp. 46–48.

*Primary Examiner*—Jacob K. Ackun
*Attorney, Agent, or Firm*—Pauley Petersen Kinne & Fejer

[57] ABSTRACT

A multi-packaging device capable of carrying containers having a range of diameters. The multi-packaging device is constructed from a plastic sheet having an array of apertures arranged in lateral rows and longitudinal ranks. The plastic sheet contains integral segments of a resilient polymer coextruded with respect to the plastic sheet or laminated on the plastic sheet. The plastic sheet may also contain a longitudinally arranged line of weakness under the resilient polymer. The resultant structure enables the multi-packaging device to maintain integrity when a large diameter container is inserted into an aperture because the resilient polymer laminate continues to stretch even after the plastic sheet reaches a stress level approaching neck-down.

15 Claims, 3 Drawing Sheets

MULTIPLE MODULES CONTAINER CARRIER

BACKGROUND OF THE INVENTION

1. Field of the Invention

This invention relates to a multi-packaging device for unitizing and carrying a plurality of containers having a range of possible container diameters.

2. Description of the Prior Art

Multi-packaging devices, such as the device according to this invention, are used to unitize a plurality of containers. Typically, containers include bottles, cans and other containers having a sidewall and a chime or raised rib around an upper portion of the container. Much of the prior art in this area, specifically multi-packaging devices constructed from elastic, polymeric materials, comprises multi-packaging devices that engage the chime or rib around the upper portion of the container. Another style of multi-packaging device is the sidewall applied carrier wherein the multi-packaging device engages the sidewall of the container.

Regardless of the style of multi-packaging device, one challenge in the art is to provide a multi-packaging device that can be used with a range of container sizes, specifically a range of container diameters. Because the container engaging portions of the multi-packaging device are generally elastic, which is governed by the modulus of elasticity or "modulus" of the multi-packaging device, the multi-packaging device relies upon the engagement of a stretched container engaging portion with the container sidewall or chime. Container diameters outside of a narrow range of diameters will either stretch the container engaging portion too much thereby permanently losing elasticity, called "neck-down," or not stretch the container engaging portion at all, both scenarios resulting in package failure.

Prior art multi-packaging devices generally require several different versions or configurations to accommodate different diameters of containers. Typically, a single design multi-packaging device can accommodate a range of container diameters of 0.200 inches. It is therefore desirable to provide a multi-packaging device that can accommodate an increased range of container diameters.

SUMMARY OF THE INVENTION

It is one object of this invention to provide a multi-packaging device that can accommodate an increased range of container diameters over the prior art.

It is another object of this invention to provide a multi-packaging device that unitizes a plurality of containers into a package that resists movement of the containers relative to each other.

It is another object of this invention to provide a device that unitizes a plurality of containers having a first diameter, which device is also capable of unitizing a plurality of containers having a second diameter.

It is a further object of this invention to provide a device that may be used in a wide range of applications thus obviating production of many different devices of varying size.

It is still another object of this invention to provide a device that is positioned around the sidewall of a container when a sidewall diameter is within an approximately one inch range of diameters.

It is yet another object of this invention to provide a device that contains weakened material that will stretch but not break and/or neck-down.

A multi-packaging device capable of accommodating a range of container diameters is preferably constructed from a thermoplastic material, such as a plastic sheet. A resilient polymer having a lower modulus than the plastic sheet is preferably integrated with the plastic sheet. The resilient polymer preferably forms discrete segments within the plastic sheet so that the multi-packaging device comprises a single, generally linear thickness.

In another preferred embodiment of the invention, longitudinally arranged lines of weakness, preferably perforations or a reduced thickness of the plastic sheet, are positioned in the plastic sheet at predetermined intervals. In this preferred embodiment of the invention, the resilient polymer is positioned on the plastic sheet contiguous with at least a portion of the line of weakness.

The plastic sheet having the integrated resilient polymer is next preferably die-cut to form a plurality of apertures, each aperture capable of receiving a container. The apertures are preferably arranged in an array of lateral rows and longitudinal ranks and formed so that the resilient polymer is adjoining the plastic sheet in one of several preferred locations. In one preferred embodiment of this invention, the resilient polymer is positioned in discrete segments within the plastic sheet and between the apertures in the lateral rows of apertures. In another preferred embodiment of the invention, the resilient polymer is positioned along outer bands in the lateral rows of apertures adjacent to the plastic sheet so that the plastic sheet is contained in the inner bands of the lateral rows of apertures. In still another preferred embodiment of the invention, the resilient polymer is positioned on the plastic sheet between the apertures in the lateral rows of apertures and contiguous with at least a portion of the perforations.

A container is then inserted into each aperture to form an assembled multi-packaging device and, depending upon the diameter of the container, the plastic sheet and/or the resilient polymer will stretch accordingly. In the embodiment of this invention having a line of weakness such as perforations or a reduced thickness of the plastic sheet, the perforations or the reduced thickness may rupture upon insertion of a large diameter container. Once the line of weakness is ruptured with a container having a large diameter, the resilient polymer will elongate to a required aperture diameter corresponding with the container. However, in any preferred embodiment of the invention, the multi-packaging device will remain in operative condition because the resilient polymer will maintain its elasticity and thus the elasticity of the entire multi-packaging device.

BRIEF DESCRIPTION OF THE DRAWINGS

The above-mentioned and other features and objects of this invention will be better understood from the following detailed description taken in conjunction with the drawings wherein.

DESCRIPTION OF THE PREFERRED EMBODIMENTS

Figure 1:
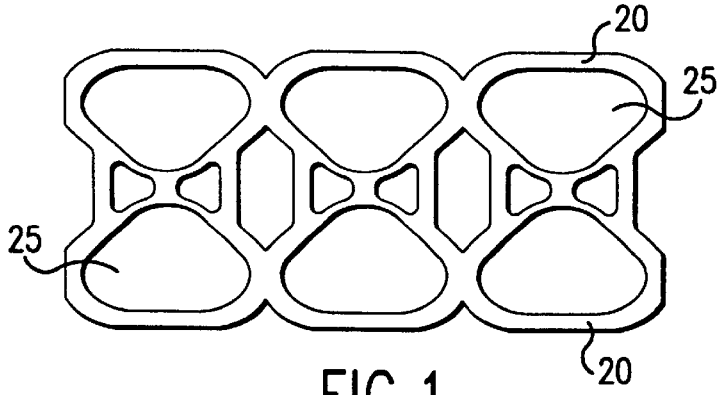
FIG.1 PRIOR ART
FIG. 1 is a top view of a prior art multi-packaging device.

FIG. 1 shows a typical prior art multi-packaging device. As discussed above, the prior art multi-packaging device is capable of accommodating a container diameter range of approximately 0.200 inches. Therefore, numerous embodiments and alterations are required to both the multi-packaging device and the multi-packaging device applicating equipment in order to accommodate a container diameter beyond the 0.200 inch range. Prior art multi-packaging devices are typically constructed from plastic sheet 20 having a single modulus and a plurality of apertures 25. The multi-packaging device shown in FIG. 1 is illustrative of the prior art and shows a device constructed from a single plastic sheet 20 without any additional materials. The physical configuration of the multi-packaging device shown in FIG. 1 may be used in connection with the invention described below.

FIGS. 2, 5, 8 and 11 show multi-packaging device 10 for carrying an array of containers according to four preferred embodiments of this invention. The physical configuration of multi-packaging device 10 shown in FIGS. 2, 5, 8 and 11 are merely illustrative and may be varied without departing from the principles of this invention.

In a manner similar to the types of multi-package carriers described above, multi-packaging device 10 according to one preferred embodiment of this invention is constructed from a thermoplastic material, preferably an extruded low- to medium-density polyethylene sheet material, or plastic sheet 20. As is common in plastic extrusion, plastic sheet 20 is extruded such that a longitudinal direction of plastic sheet 20 is in a machine direction, by definition the direction of the extrusion that is perpendicular to an extrusion die, and the lateral dimension of plastic sheet 20 is in a transverse direction, the direction of the extrusion that is parallel with the extrusion die.

In three preferred embodiments of this invention, shown separately in FIGS. 2–4, 5–7 and 11–13, resilient polymer 40 is integrated, along a single plane, with plastic sheet 20 in multi-packaging device 10 so as to create discrete segments of resilient polymer 40 integrated with respect to plastic sheet 20. Resilient polymer 40 may be coextruded, welded, or otherwise joined with respect to plastic sheet 20 to create a single, linear thickness of multi-packaging device 10. Welded as used in the specification and claims may be defined as a hot weld, cold weld, lamination or other method of joining two materials known to those having ordinary skill in the art.

Figure 4:
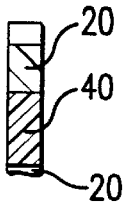
FIG. 4 is a cross-sectional view along section A—A shown in FIG. 3.
Figure 7:
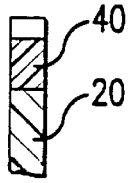
FIG. 7 is a cross-sectional view along section B—B shown in FIG. 6.
Figure 13:
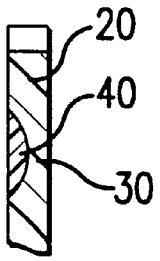
FIG. 13 is a cross-sectional view along section D—D shown in FIG. 12.

Depending upon the methods employed for integrating resilient polymer 40 with plastic sheet 20, resilient polymer 40 and plastic sheet 20 may slightly overlap one another or have slight thickness variations with respect to each other. FIGS. 4, 7 and 13 show cross-sectional views, according to three preferred embodiments of the invention, of multi-packaging device 10 wherein resilient polymer 40 and plastic sheet 20 form a single thickness multi-packaging device 10 containing two separate materials. It is desirable to use resilient polymer 40 that is compatible with plastic sheet 20 for reprocessing and recycling purposes.

Resilient polymer 40 preferably has a lower modulus than the modulus of plastic sheet 20 and is thus more elastic than plastic sheet 20. Therefore, resilient polymer 40 preferably stretches a greater amount than plastic sheet 20 when exposed to an equal stress as plastic sheet 20. As used throughout the specification and claims, a material having a lower modulus has more elasticity than a material having a higher modulus. Although carrier 10 may be constructed entirely from a material having a lower modulus such as resilient polymer 40, the cost of such carrier 10 is prohibitive for extensive commercial use.

Figure 8:
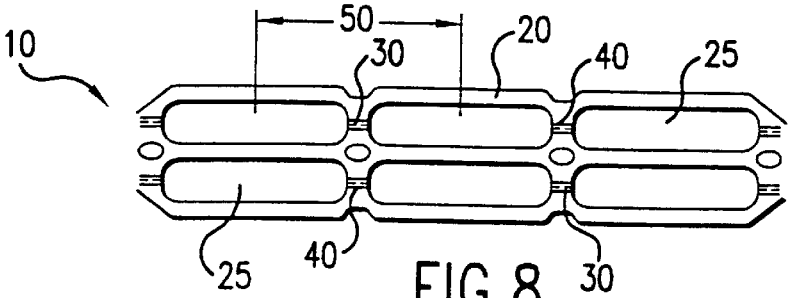
FIG. 8 is a diagrammatic top view of the multi-packaging device according to one preferred embodiment of the invention.
Figure 9:
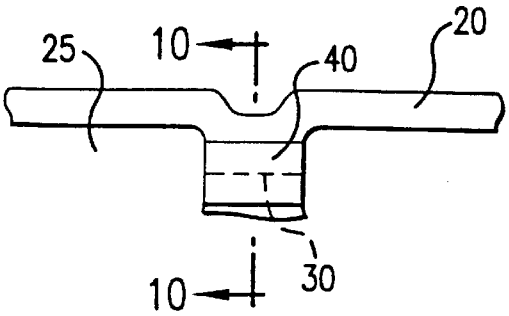
FIG. 9 is a diagrammatic enlarged view of a portion of the multi-packaging device shown in FIG. 8.
Figure 10:
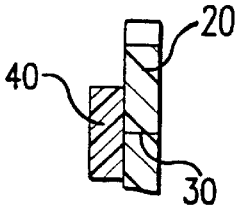
FIG. 10 is a cross-sectional view along section C—C shown in FIG. 9.

In one preferred embodiment of this invention, shown in FIGS. 8–10, a plurality of longitudinally arranged lines of weakness, preferably perforations 30, are positioned in plastic sheet 20 at predetermined intervals along plastic sheet 20. Perforations 30 may be added with a perforation wheel or some other means of perforating plastic sheet 20 known to those having reasonable skill in the art. In another preferred embodiment of this invention, perforations 30 may be replaced with some other means of weakening plastic sheet 20 such as reducing a thickness of plastic sheet 20 along similar longitudinal lines.

In a preferred embodiment of this invention shown in FIGS. 8–10, resilient polymer 40 is positioned on plastic sheet 20 contiguous with at least a portion of perforations 30. As shown in FIG. 8, in an enlarged view in FIG. 9, and in cross-section in FIG. 10, in one preferred embodiment of this invention, resilient polymer 40 is positioned completely over the line of perforations 30 in plastic sheet 20. Resilient polymer 40 may be laminated on plastic sheet 20, extrusion coated on plastic sheet 20 or co-extruded with plastic sheet 20. Alternatively, resilient polymer 40 may be sprayed, taped, roller coated or otherwise applied to plastic sheet 20 using processing techniques known to those skilled in the art. In this preferred embodiment of the invention, resilient polymer 40 and plastic sheet 20 form a cross-section, shown in FIG. 10 as section C—C from FIG. 9, having a greater thickness than plastic sheet 20 alone. Resilient polymer 40 is preferably applied to plastic sheet 20 prior to stamping individual multi-packaging device 10.

Figure 11:
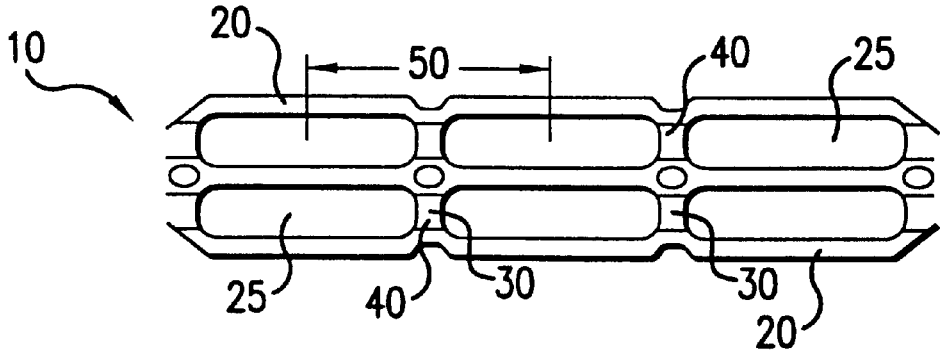
FIG. 11 is a is a diagrammatic top view of the multi-packaging device according to one preferred embodiment of the invention.
Figure 12:
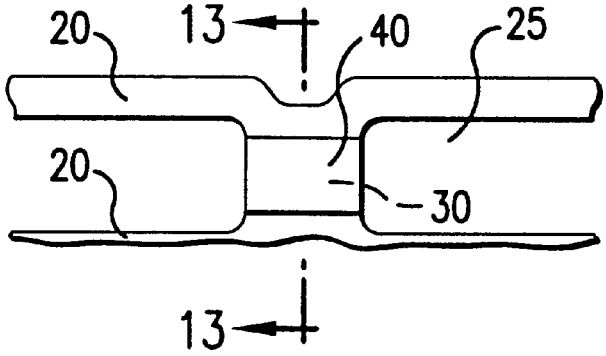
FIG. 12 is a diagrammatic enlarged view of a portion of the multi-packaging device shown in FIG. 11.

In one preferred embodiment shown in FIGS. 11–13, resilient polymer 40 is co-extruded, or otherwise integrated, with plastic sheet 20 to form a cross-section, shown in FIG. 13 as section D—D from FIG. 12. As shown in FIG. 13, plastic sheet 20 has a reduced thickness forming a channel comprising resilient polymer 40.

After resilient polymer 40 is integrated with, or applied to, plastic sheet 20, the resulting material sheet is preferably stamped or die-cut to create individual multi-packaging devices 10. Although as described, plastic sheet 20 is die-cut after the integration of plastic sheet 20 and resilient polymer 40, plastic sheet 20 may be die-cut before the addition of either or both of line of weakness 30 and resilient polymer 40 for the preferred embodiment of this invention shown in FIGS. 8–10 and described above. Plastic sheet 20 is preferably formed using a punch press to die cut and extract material and create the features of multi-packaging device 10 described below.

Plastic sheet 20 having integrated resilient polymer 40 is die-cut to form a plurality of apertures 25, each aperture 25 capable of receiving a container. Apertures 25 are preferably arranged in an array of lateral rows and longitudinal ranks. As shown in FIGS. 2, 5, 8 and 11, a preferable array is an arrangement of two rows and three ranks to form multi-packaging device 10 for holding six containers. It should be noted, however, that although FIGS. 2, 5, 8 and 11 show multi-packaging device 10 for holding six containers, the invention is not intended to be so limited and multi-packaging device 10 may contain any feasible array of apertures 25.

Figure 2:
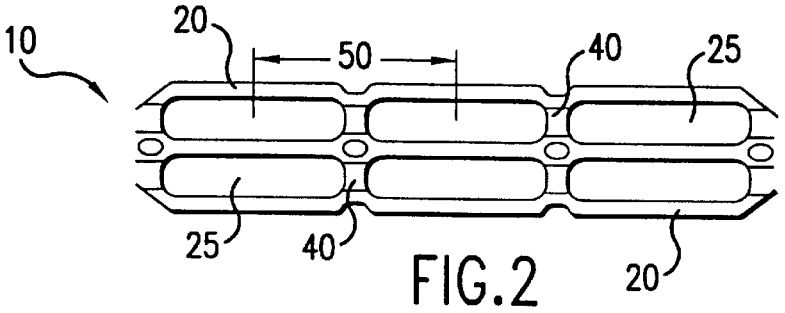
FIG. 2 is a diagrammatic top view of the multi-packaging device according to one preferred embodiment of the invention.
Figure 3:
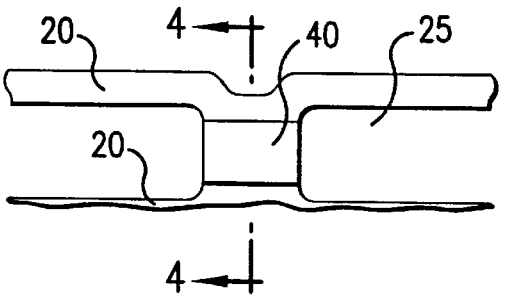
FIG. 3 is a diagrammatic enlarged view of a portion of the multi-packaging device shown in FIG. 2.

In one preferred embodiment of this invention, shown in FIGS. 2 and 11, apertures 25 are formed so that resilient polymer 40 is longitudinally arranged and positioned between apertures 25 in the lateral rows of apertures 25. This configuration permits resilient polymer 40 to stretch in high stress areas between apertures 25 and avoids the tendency of plastic sheet 20 in that area to neck-down.

Apertures 25 are preferably ovals arranged with a major axis of aperture 25 extending in the longitudinal direction. However, apertures 25 may comprise any opening, preferably, though not necessarily, an elongated opening having an elongation in the longitudinal direction. As shown in FIGS. 2, 5, 8 and 11, apertures 25 are narrower in the lateral direction than prior art apertures, as shown in FIG. 1. Narrower apertures 25 permit the manufacture of additional lanes of multi-packaging devices 10 using the same amount of lateral sheet material used in prior art multi-packaging devices.

Figure 5:
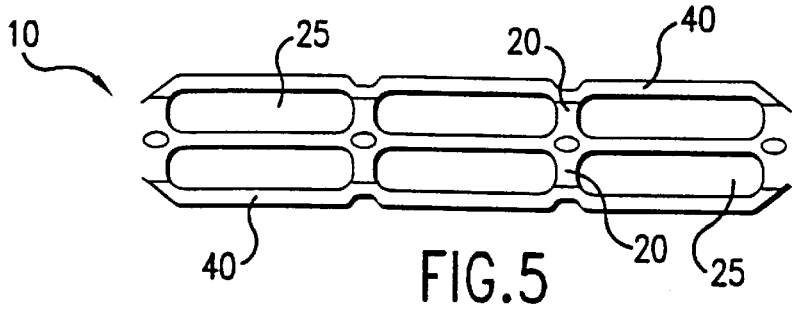
FIG. 5 is a diagrammatic top view of the multi-packaging device according to another preferred embodiment of the invention.
Figure 6:
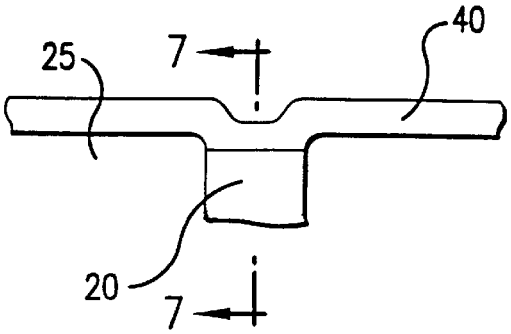
FIG. 6 is a diagrammatic enlarged view of a portion of the multi-packaging device shown in FIG. 5.

In another preferred embodiment of this invention, shown in FIG. 5, apertures 25 are formed so that resilient polymer 40 is longitudinally arranged and positioned along outer bands of the lateral rows of apertures 25 in multi-packaging device 10. The outer bands of the lateral rows of apertures 25 are approximately that portion of multi-packaging device 10 visible along a perimeter of an assembled multi-packaging device 10 with containers engaged with apertures 25. This configuration permits resilient polymer 40 to stretch to accommodate multiple container diameters but still allows plastic sheet 20, having the higher modulus, to absorb the larger stresses present in the central area of multi-packaging device 10.

In another preferred embodiment of this invention, shown in FIG. 8, apertures 25 are formed so that line of weakness 30, such as perforations, and therefore also resilient polymer 40, are longitudinally arranged and positioned between apertures 25 in the lateral rows of apertures 25. In this preferred embodiment of this invention, the line of perforations or other line of weakness 30 bisects a minor axis of apertures 25, or other longitudinal direction of aperture 25. Depending upon the physical properties of plastic sheet 20 and resilient polymer 40, line of weakness 30, such as perforations or a reduced thickness of plastic sheet 20, may be offset with respect to a center of the minor axis of apertures 25 to attain the desired characteristics.

In yet another preferred embodiment of this invention, shown in FIG. 11, apertures 25 are formed so that resilient polymer 40 is longitudinally arranged and positioned between apertures 25 in the lateral rows of apertures 25. However, resilient polymer 40 may be co-extruded in any other position within carrier 10 that results in preferable stretching characteristics.

In a specific current embodiment of this invention, multi-packaging device 10 may contain apertures 25 having pitch 50 of approximately 3 inches. Pitch 50 is a dimension between a center point of adjacent apertures 25 in the longitudinal rows. Pitch 50 dimension is important because that dimension must be maintained for use of multi-packaging device 10 on conventional applicating equipment used to apply multi-packaging device 10 onto containers. A constant pitch 50 within multi-packaging device 10 allows the use of a single style of applicating equipment for use with a range of container diameters. In prior art multi-packaging devices, maintaining pitch 50 dimension required altering multi-packaging device 10 in other dimensions in order to accommodate different container diameters.

Resilient polymer 40 preferably has a lower modulus than the modulus of plastic sheet 20 and is thus more elastic than plastic sheet 20. In one preferred embodiment of this invention, resilient polymer 40 is a metallocene or polyolefin plastomer. Resilient polymer 40 may comprise any other material known to those having ordinary skill in the art and exhibiting such characteristics as high stretch, low modulus and high clarity.

In the preferred embodiments of the invention shown in FIGS. 2–7, when containers are inserted into multi-packaging device 10 to create an assembled multi-packaging device 10, containers having small diameters will cause multi-packaging device 10 to stretch resilient polymer 40. As larger diameter containers are inserted into multi-packaging device 10, plastic sheet 20 and resilient polymer 40 will stretch until reaching a predetermined stress level at which level resilient polymer 40 will become strain-hardened and thus stretch at a disproportionately slower level than plastic sheet 20. In this manner, multi-packaging device 10 can unitize and engage a range of container diameters without loss of elasticity, or neck-down, of either plastic sheet 20 or resilient polymer 40.

In a preferred embodiment of the invention having longitudinal lines of weakness 30 such as perforations, shown in FIGS. 8–10, or a reduced thickness of plastic sheet 20 forming line of weakness 30, shown in FIGS. 11–13, when containers are inserted into multi-packaging device 10, line of weakness 30 may rupture depending upon the induced lateral stress exerted on plastic sheet 20. However, multi-packaging device 10 will remain in operative condition because resilient polymer 40 will maintain its elasticity and thus the elasticity of the entire multi-packaging device 10. This effects a more sudden transition from the modulus of plastic sheet 20 to the modulus of resilient polymer 40 than the embodiments of the invention wherein plastic sheet 20 and resilient polymer 40 are linearly integrated.

Multi-packaging device 10 will therefore unitize groups of containers having a range of diameters. Typical current containers, specifically bottles, have diameters that range between approximately 2.6 inches and approximately 2.9 inches. Multi-packaging device 10 according to this invention will permit a single size device to engage a relatively broad range of existing and conceivable containers.

Multi-packaging device 10 is preferably sized based upon the modulus of plastic sheet 20 to be used for the smallest container diameter in the acceptable range of container diameters, such as a current low-end container diameter of 2 inches. The stretch properties, and relative modulus, of resilient material 40 is determined from the largest container diameter in the acceptable range of container diameters, such as a current high-end container diameter of 3 inches. Pitch 50 is sized to accommodate the largest container diameter, for example 3 inches, within the acceptable range of container diameters. Apertures 25 in a center portion of multi-packaging device 10 may require a smaller size than apertures in an outer portion of multi-packaging device 10 to minimize "puckering" in an assembled multi-packaging device 10.

While in the foregoing specification this invention has been described in relation to certain preferred embodiments thereof, and many details have been set forth for purposes of illustration, it will be apparent to those skilled in the art that the apparatus is susceptible to additional embodiments and that certain of the details described herein can be varied considerably without departing from the basic principles of the invention.

I claim:

1. A multi-packaging device for carrying an array of containers in a corresponding array of apertures, the multi-packaging device comprising:

a plastic sheet having the apertures arranged in lateral rows and longitudinal ranks and having a first modulus;

a resilient polymer integrated with the plastic sheet, the resilient polymer having a second modulus lower than the first modulus.

2. The multi-packaging device of claim 1 wherein discrete segments of the resilient polymer adjoin the plastic sheet.

3. The multi-packaging device of claim 1 wherein the resilient polymer and the plastic sheet together comprise a single, generally linear thickness.

4. The multi-packaging device of claim 1 wherein the resilient polymer is positioned along a longitudinal line between apertures in the lateral rows of apertures.

5. The multi-packaging device of claim 1 wherein the resilient polymer is positioned along outer bands in the lateral rows of apertures.

6. The multi-packaging device of claim 1 wherein the resilient polymer is welded with respect to the plastic sheet.

7. The multi-packaging device of claim 1 wherein the resilient polymer is coextruded with the plastic sheet.

8. A multi-packaging device for carrying an array of containers, the multi-packaging device comprising:

a plastic sheet, the plastic sheet having a plurality of apertures each for receiving one of the containers, the apertures arranged in lateral rows and longitudinal ranks;

the plastic sheet having a longitudinally arranged line of weakness positioned between apertures in the lateral rows of apertures; and a resilient polymer integrated with the plastic sheet contiguous with at least a portion of the line of weakness.

9. The multi-packaging device of claim 8 wherein the line of weakness comprises a line of perforations.

10. The multi-packaging device of claim 8 wherein the line of weakness comprises a reduced thickness of the plastic sheet.

11. The multi-packaging device of claim 8 wherein the resilient polymer is more elastic than the plastic sheet.

12. The multi-packaging device of claim 8 wherein each of the apertures are elongated openings arranged in a longitudinal direction.

13. The multi-packaging device of claim 12 wherein the line of weakness bisects the longitudinal direction of the apertures.

14. A method for packaging containers using a plastic sheet having an array of apertures each for receiving one of the containers, the apertures capable of holding containers having different diameters, the method comprising:

weakening the sheet between apertures in lateral rows of the array of apertures so that a longitudinal line of weakness is formed between apertures in the lateral rows of the array of apertures; and integrating a resilient polymer with the sheet contiguous with the longitudinal line of weakness.

15. The method of claim 14 wherein the line of weakness is formed by perforating the sheet.

* * * * *